United States Patent [19]

Scholl

[11] Patent Number: 4,616,586

[45] Date of Patent: Oct. 14, 1986

[54] UPPER FEEDING DEVICE OF A SEWING MACHINE

[75] Inventor: Hans Scholl, Oerlinghausen-Lipperreihe, Fed. Rep. of Germany

[73] Assignee: Kochs Adler, AG, Fed. Rep. of Germany

[21] Appl. No.: 742,695

[22] Filed: Jun. 7, 1985

[30] Foreign Application Priority Data

Jun. 28, 1984 [DE] Fed. Rep. of Germany ..... 3423843

[51] Int. Cl.[4] ..... D05B 27/04

[52] U.S. Cl. ..... 112/320; 112/311

[58] Field of Search ..... 112/311, 320, 321, 312

[56] References Cited

U.S. PATENT DOCUMENTS 3,927,629 12/1975 Vollmar ..... 112/320
4,116,145 9/1978 Nicolay ..... 112/320
4,341,172 7/1982 Thompson ..... 112/320 X
4,422,398 12/1983 Dusch .
4,446,803 5/1984 Nicolay et al. ..... 112/320
4,476,796 10/1984 Vollmar ..... 112/320

*Primary Examiner*—Werner H. Schroeder
*Assistant Examiner*—Andrew M. Falik
*Attorney, Agent, or Firm*—Laff, Whitesel, Conte & Saret

[57] ABSTRACT

The present invention provides an upper feeding device of a sewing machine comprising a feeding presser foot and a holding presser foot alternatingly cooperating with it, to which is imparted by means of an oscillating means and a angle lever coupled thereto, an up and down motion extending perpendicular to a throat plate of the sewing machine. To provide an optimal drive of the presser feet, the oscillating means is formed by a cam means coacting with a jogging mechanism coupled to the angle lever. The jogging mechanism is provided with a translatorily movable slider extending vertically to the direction of movement of the presser feet. The slider is drivable at an interchangeable lever ratio by a shaft via a slide block-guide.

13 Claims, 6 Drawing Figures

UPPER FEEDING DEVICE OF A SEWING MACHINE

FIELD OF THE INVENTION

The invention relates to an upper feeding device of a sewing machine comprising a feeding presser foot and a holding presser foot alternatingly cooperating with it to which is imparted by means of an oscillating means and an angle lever coupled thereto, an up and down motion extending perpendicular to a throat plate of the sewing machine.

BACKGROUND OF THE INVENTION

A known upper feeding device of a suitable kind is disclosed in U.S. Pat. No. 4,422,398 in which up and down motions directed perpendicular to the throat plate of the machine are imparted to a presser foot executing a feeding motion and a presser foot alternately reciprocating with the latter by means of a multi-member gear via an angle lever. The speed of said up and down motion approaches zero during the touch-down phase of the presser feet. To improve the operating characteristics the gear includes a steering arm transmission, the ratio of which can be varied by a linkage gear acting at double the frequency of the gear. This is intended to result in a low-wear lifting drive for the upper feeding device which is almost maintenance-free and thus also permits high sewing speeds. For this purpose the linkage gear has a second eccentric which is driven by the arm shaft, said eccentric being joined to the steering arm transmission via an eccentric rod, a rocker, a coupling member and a rocker lever so that the coupling member and the rocker oscillate between two points which are the same distance apart from the stretched position of the coupling member and the arm of the rocker connected thereto. This known embodiment has the disadvantage that the alternating moment i.e the intent of change over of the two presser feet also varies when the thickness of the workpiece varies. Furthermore, the strokes of the presser feet change when the thickness of the material varies. When the strokes of the presser feet vary, this in turn changes the alternating moment of the presser feet. With different stroke settings the ratio of the strokes of the two presser feet to each other changes. The size of the change in stroke is limited kinetically by the basic design of the adjusting gear because unfavorable transmission ratios result from very small and very large strokes. Furthermore, the alternating moments of the presser feet cannot be selected independently of each other. Moreover, free selection of acceleration to achieve a particularly favorable motion is not possible. Finally, numerous components and links with very little play are necessary.

SUMMARY OF THE INVENTION

The object of the invention is to design an upper feeding device of a suitable kind in which the presser feet are optimally driven.

According to the invention the oscillating means coacts with a jogging mechanism coupled to the angle lever. By a corresponding design of the oscillating means as a cam means optimal acceleration and thus, for example, a particularly soft touch-down of the presser feet can be achieved. Thus particularly quiet running and a high stability of the cam means is achieved.

It is very advantageous if the jogging mechanism is provided with a translatorily movable slider and if the slider is extendable perpendicular to the direction of movement of the presser feet. Furthermore, there are measures to attain a variable stroke of the presser feet without the alternating moment of the presser feet being affected. Basically, these measures can also be used independent of the oscillating means being formed by a cam gear coacting with a jogging mechanism coupled to the angle lever. For example, a crank means can also be used instead of a cam means.

Furthermore, there are features which permit automatic adjustment to differing thicknesses of the workpieces without the strokes of the presser feet relative to the workpiece being altered and without the alternating moment or smooth motion being affected.

Other objects, advantages and features of the present invention appear from the detailed description of a preferred embodiment which will now be explained in conjunction with the accompanying drawings.

DESCRIPTION OF THE PREFERRED EMBODIMENT

Figure 1:
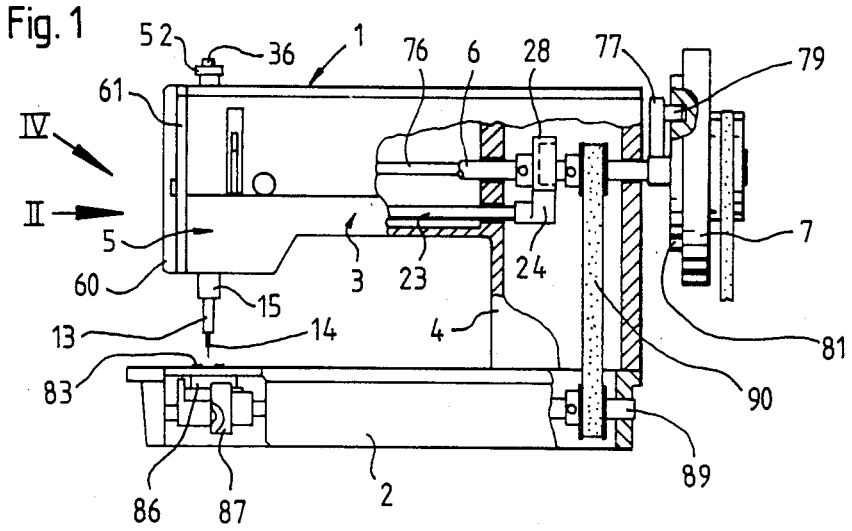
FIG. 1 is a partially broken open side elevation of a sewing machine.

Referring to the drawings, there is illustrated a sewing machine 1 usually comprising a base plate 2 and an arm 3, which, on the one hand, is connected to the base plate 2 by a standard 4 and, on the other hand, is terminating in a head 5. In the arm 3 there is pivoted an arm shaft 6, to the end of which turned to the standard 4 is fastened a handwheel 7. In the area of the head 5 the arm shaft 6 is provided with a crank 8 having a crankpin 9 for rotatably receiving a connecting rod 10. The free end of the connecting rod 10 is rotatably connected to a needle bar connecting stud 11 fastened to a vertically arranged needle bar 13 by means of a setscrew 12. At its lower end the needle bar 13 carries a needle 14. The needle bar 13 is supported in a needle bar jogging frame 15 and displaceable in its longitudinal direction. The needle bar jogging frame 15 is swingably supported in a bearing 17 by means of a bearing bolt 16 extending concentrically with respect to the arm shaft 6. The bearing bolt 16 is located in the head 5. The bearing bolt 16 and the bearing 17 are arranged above and in alignment with the needle bar 13. The needle bar jogging frame 15 is provided with an upper bearing 18 located above the needle bar connecting stud 11, and a lower bearing 19, in which the needle bar 13 is supported for displacement in longitudinal direction. In the lower area of the needle bar jogging frame 15 there is secured a pivot pin 20, to which is supported a tie rod 21. To the other end of the tie rod 21 is hinged a lever 22, the free end of which in turn is fastened to a shaft 23, which is concentrically supported with respect to the arm shaft 6 in the arm 3. Inside of the arm 3 the shaft 23 is provided with a lever 24, which is connected via a hinge joint 25 to a further tie rod 26. At the end turned away from the hinge joint 25 the tie rod 26 is provided with an eye 27 rotatably embracing an eccentric 28, which is connected to the arm shaft 6. The needle bar jogging frame 15 is oscillatingly driven by the eccentric 28 via the tie rod 26, the levers 24 and 22 and the tie rod 21 thus driving the needle bar 13 synchronously with respect to its up and down movements.

Figure 3:
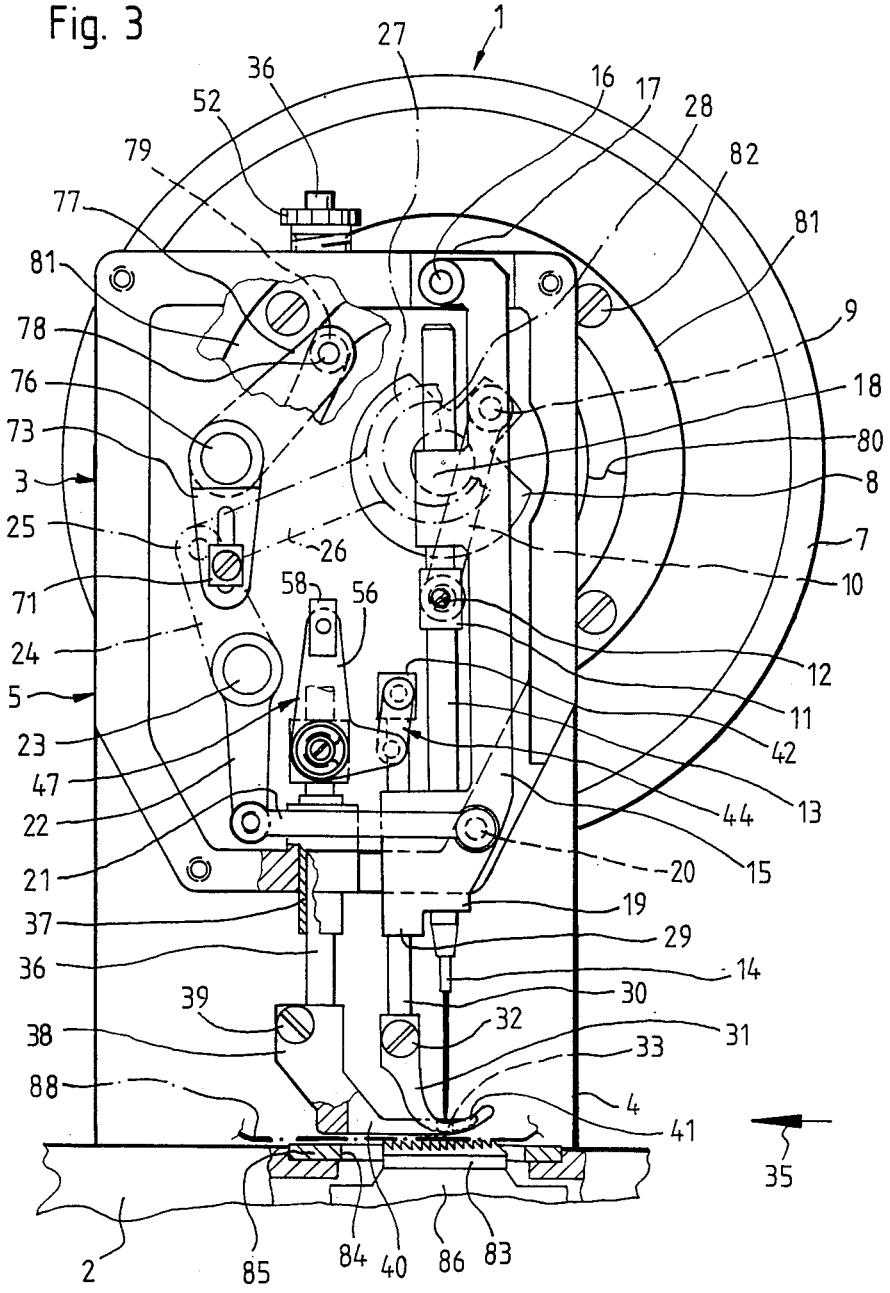
FIG. 3 is a view according to FIG. 2 with cover and bearing frame removed.

In the lower area of the needle bar jogging frame 15 adjacent to the lower bearing 19 there is formed a slide bearing 29 for receiving a presser foot bar 30, which is movable parallelly with respect to the needle bar 13. To the lower end of the presser foot bar 30 there is fastened a presser foot 31 by means of a screw 32. The presser foot 31 is formed with an opening 33 for the passage of the needle 14. The movable presser foot 31 is provided at its lower surface with a profile 34, e.g. with teeth. The needle 14 and the movable presser foot 31 are symmetrically arranged to each other in their oscillating plane specified by the oscillating movement of the needle bar jogging frame 15. In FIG. 3 this oscillating plane is denoted by an arrow 35.

In the head 5 there is supported a further presser foot bar 36 in a bearing bushing 37 stationarily arranged in the head 5, so that the presser foot bar 36 can only move in its longitudinal direction. Therefore, the presser foot bar 36 is called a stationary one.

To the lower end of the stationary presser foot bar 36 there is secured a presser foot 38 by means of a screw 39. The presser foot 38 is formed with two webs 40 for receiving therebetween with play the lower range 41 of the movable presser foot 31 provided with the opening 33 and the profile 34.

The presser foot bar 30 displaceably supported in and movable with the needle bar jogging frame 15, is provided at its upper end located above the slide bearing 29 with a shoulder 42. The shoulder 42 is formed with a supporting stud 43, to which is swingably supported a link 44. The other end of the link 44 is hingedly connected via a bolt 45 to one end of an angle lever 47. To the stationary presser foot bar 36 there is fastened a bearing block 48 by means of a setscrew 49. The bearing block 48 is formed with a supporting stud 50, to which the angle or triangle level 47 is swingably supported and axially secured by means of a retaining ring 51.

Figure 2:
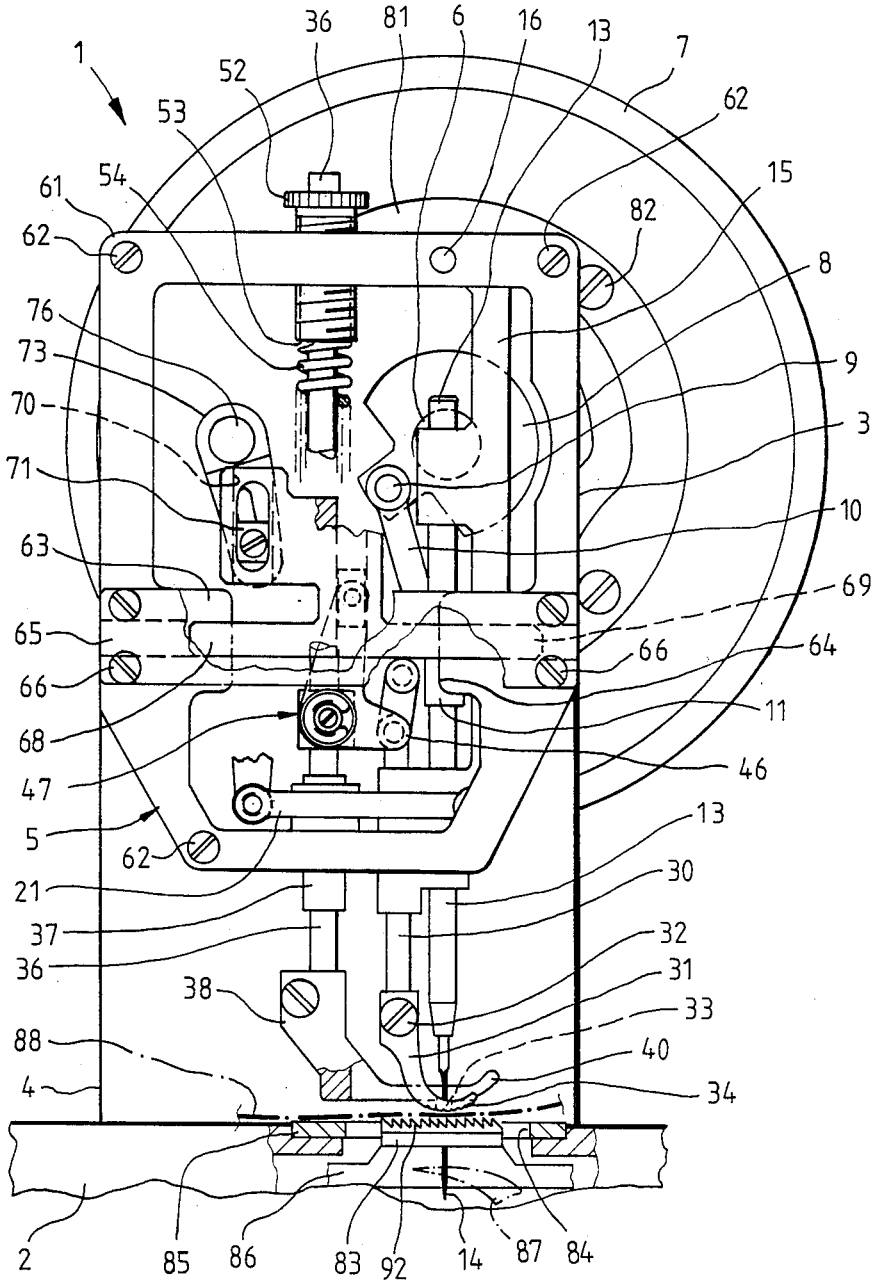
FIG. 2 shows the head of the sewing machine with the cover removed in the direction of the arrow II in FIG. 1.

As obvious from FIGS. 1 to 3, the stationary presser foot bar 36 extends upwardly through the wall of the head 5. Here, the stationary presser foot bar 36 is guided by an adjusting screw 52 screwed into the head 5. To the lower front surface of the adjusting screw there is supported a pressure spring 54, which surrounds the presser foot bar 36. The free end of the pressure spring 54 supports to the upper front surface 55 of the bearing block 48. The tension of the pressure spring 54 may be altered by changing the depth of adjusting screw 52 into the head 5.

Figure 4:
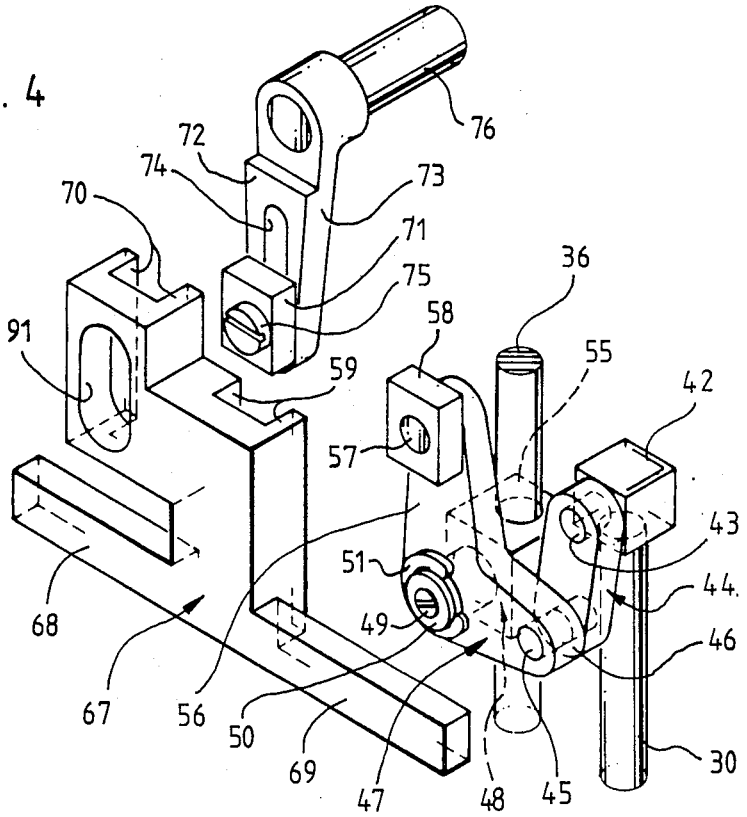
FIG. 4 is a perspective exploded view of the essential components according to the invention according to the arrow IV in FIG. 1, on an enlarged scale.

As especially obvious from FIG. 4, the angle lever 47 is provided with a substantially horizontal extending end 46 and a substantially upwards extending end 56, to which is hinged a slide block 58 by means of a pivot 57. The slide block 58 is displaceably guided in a vertically extending guide 59 formed as a recess.

The front surface of the head 5 is closed by a removable cover 60. Directly below the cover 60 there is secured to the head 5 a bearing frame 61 by means of screws 62. In the area below the arm shaft 6, the bearing frame 61 is formed with two flushing projections 63, 64 extending inwardly. To the projections 63, 64 there is fastened by means of screws 66 a guide member 65, in which is horizontally displaceable supported in a plane according to FIG. 2 a slider 67 by means of guide webs 68, 69. The vertically extending guide 59 formed as a recess is located in the slide 67 and as dimensioned as the slide block 58 is displaceably guided therein with little play.

In the slide 67 there is arranged a further guide 70 formed as a recess and extending parallelly with respect to the guide 59. This guide 70 serves for displaceably receiving and guiding a slide block 71 with little play. The slide block 71 is rotatably and adjustably in longitudinal direction arranged on a surface 72 of a lever 73. For this reason the lever 73 is formed with an oblong hole 74 for rotatably receiving a shoulder screw 75, which may be secured in position by a not shown nut. The afore described bearing of the slide block 71 at the lever 73 renders it possible to adjust the operative length of the latter.

The lever 73 is connected to one end of a shaft 76, which extends parallelly with respect to the arm shaft 6 and is pivoted in the arm 3. The lever 73 coupled to the shaft 76 and bearing the slide block 71, the guide 70, the slide 67, the guide 59 and the slide block 58 form a jogging mechanism. The other end of the shaft 76 passes through the wall of the arm 3 in the area of the handwheel 7. To this free end of the shaft 76 a lever 77 is fixedly secured. The lever 77 is formed with a pivot 78 for receiving a roller 79. The roller 79 is guided with play in a closed groove 80 of a cam disk 81 carried by the handwheel 7. The cam disk 81 is detachably secured to the handwheel 7 by means of screws 82. The cam disk 81 including the groove 80 and the lever 77 mounted on the shaft 76 and incuding the roller 79 form an oscillating means.

In the base plate 2 a lower feed dog 83 is provided extending symmetrically with respect to the lower area 41 of the presser foot 31. The feed dog 83 projects through a recess 84 in a throat plate 85, which is formed at the base plate 2. Furthermore, the feed dog 83 is mounted in the usual manner on a bar 86, which in known manner is moved to and fro and up and down by a not shown feeding gear, so that the feed dog 83 performs a usually so-called quadrangular movement, i.e. a nearly elliptical movement, while the sewing machine 1 is running.

The needle 14 cooperates with a looper 87 for producing a seam in a workpiece 88, which is illustrated in FIGS. 2 and 3 by dot-dash lines. The looper 87 is arranged in the base plate 2.

While the lower area 41 of the reciprocatingly drivable presser foot 31 is associated with the feed dog 83 for receiving the workpiece 88 therebetween, the webs 40 and of the non-swingable presser foot 38 only contact the throat plate 85 when the workpiece 88 placed on the latter.

The looper 87 is driven by a shaft 89, which is supported in the base plate 2 and driven by the arm shaft 6 via a timing belt drive 90. Also the not shown feeding gear is driven by the aforesaid drive combination.

Operation of therefore described sewing machine 1 is as follows:

When turning the handwheel 7 the needle bar 13 is reciprocatingly driven. Also the needle bar jogging frame 15 is reciprocatingly driven in the path according to FIGS. 2 and 3 by means of the eccentric 28 and via the tie rod 26, the lever 24, the shaft 23, the lever 22 and the tie rod 21. This reciprocating motion corresponds exactly to the feed motion of the feed dog 83. At this instant, when the needle bar jogging frame 15 begins to swing into the direction of the arrow 35, the needle 14 enters the workpiece 88. As the presser foot 30 together with the presser foot 31 is supported in the needle bar jogging frame 15, the workpiece 88 is advanced by the presser foot 31 and the feed dog 83 into the direction of the arrow 35, while the needle 14 in the workpiece 88 passes its lower dead center. Such a feeding system is known as a so-called needle feed system. As the presser foot 31 performs the same feed motion as the needle 14 it is called a feeding presser foot for the same reason the presser foot bar 30 is called a feeding presser foot bar.

In order to reduce frictional forces preform to the workpiece 88 while being advanced into the direction of the arrow 35, it is required to lift the presser foot 38 from the workpiece 88. As the presser foot 38 supported in the head 5 and the associated presser foot bar 36 only perform the vertically extending lift motion but otherwise are arranged relatively stationary with respect to the base plate 2 they are called holding presser foot 38 resp. holding presser foot bar 36.

At this instant, after the feed motion of the workpiece 88 is terminated, the needle 14 is already upwardly withdrawn from the workpiece 88. The feed dog 83 is placed away downwardly. Simultaneously, the feeding presser foot 31 is lifted. Lifting of the feeding presser foot 31 occurs when the holding presser foot 38 has already pressed the workpiece 88 again against the throat plate 85, so that, due to the corresponding frictional forces, the workpiece 88 is nondisplaceably held with respect to the base plate 2. The alternating lifting and lowering of the presser feet 31 and 38 is obtained by a rotary-swing motion of the shaft 76 caused by the correspondent construction of the groove 80 in the cam disk 81. The rotary-swing motion of the shaft 76 is converted via the lever 73 into a horizontal translatory swing motion of the slide 67 extending vertically with respect to the direction of motion of the holding presser foot bar 36 and parallelly with respect to the path set by the presser foot bars 30, 36. Accordingly, the slide 67 imparts via the slide block 58 to the angle or triangular lever 47 a swing motion about the setscrew 49, so that the horizontally extending one end 46 of the angle lever 47 imparts to the two presser foot bars 30, 36 reciprocating oppositely directed up and down motions. As the whole system consisting of the two presser foot bars 30, 38 and the angle lever 47 with the link 44, is vertically displaceable and pressed by the pressure spring 54 into the direction towards the throat plate 85, one of the two presser feet 31, 38 is lowered upon the workpiece 88 due to the reciprocating oppositely directed up and down motions, while the other presser foot 38 of 31 is lifted. As the above described system is vertically displaceable in the guide 59 of the slide 67 by means of the slide block 58, an automatic compensation of the thickness of the workpiece 88 is achieved, i.e. there is no need to compensate the workpiece thicknesses within the ranges of adjustment given by the sewing machine.

At different workpiece thicknesses the strokes of the presser feet 31 resp. 38 remain constant in relation to the upper surface of the workpiece 88. Also the alternating moment, i.e. at which time the one presser foot is lowered or the other one is lifted or vice versa, remains constant. An alteration of the strokes of the presser foot bars 30 and 36 is possible by shifting the slide block 71 on the lever 73. Such an adjustment is easily achieved by a screw driver passed through the recess 91 of the slide 67 covering the oblong hole 74. Such an alteration of the strokes, i.e. such an adjustment of the strokes of the presser foot bars 30, 36, does not alter their alternating moment.

The cam disk 81 with the gxoove 80 and the lever 77 with the roller 79 secured to the shaft 76 form a cam gear. A suitable profile of the groove 80 renders possible that the presser feet 31, 38 impact relatively smooth, thus achieving a so-called reduction of impact.

A correspondent construction of the groove 80 resp. a correspondent exact angular arrangement of the cam disk 81 at the handwheel 7 renders possible to kinematically match the lifting and lowering of the presser feet 31, 38 with the remaining operating sequences of the sewing machine.

Furthermore, a correspondent profile of the groove 80 renders possible to avoid abrupt alterations of acceleration, so that a smooth running of the sewing machine and a high stability of the crank drive is obtained.

As slide bars are profided formed by the only linearly displaceable slide 67 and the guides 70, 59 with the slide blocks 71, 58, the already mentioned constancy of the alternating moments is also achieved at different workpiece thicknesses and at different strokes.

Even if different strokes of the two presser feet 31 resp. 38 were generated by a correspondent profile of the groove 80, the different stroke ratio remains constant even if a total adjustment of stroke takes place. Further details of the kinematics are explained in conjunction with the diagrams accordi 5*a* and 5*b*. Here, the term "stroke" means maximum amplitude of stroke.

Figure 5A:
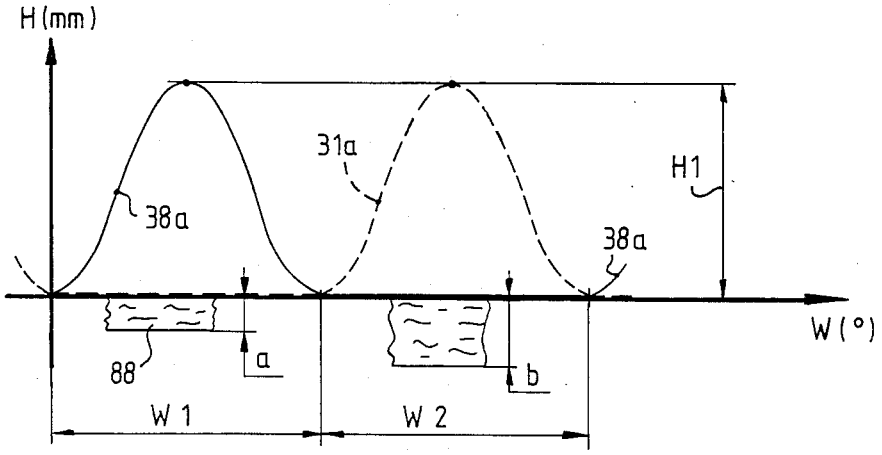
FIG. 5*a* and 5*b* are diagrams of sequences of motions of the presser feet with respect to the different parameters.

In order to simplify the illustration it is assumed that the desired strokes of the two presser feet 31 and 38 are equal. In FIG. 5*a* the lifting movements H of the presser feet 31, 38 are illustrated above the angle of rotation W of the arm shaft 6 with the maximum stroke being denoted with H1. The stroke of the holding presser foot 38 is drawn by a full line 38*a*, while the stroke of the feeding presser foot 31 is drawn by a dash line 31*a*. It is obvious from the drawing that when the holding presser foot 38 lowers onto the upper surface of the workpiece 88 after passing the angle of rotation W1, the feeding presser foot 31 rises and remains lifted by a further angle of rotation W2, i.e. $W1+W2=360°$. The identical stroke H1 remains constant independent of whether the workpiece 88 has a thickness "a" or "b". For simplification, in FIG. 5*a* the upper surface of the workpiece 88 each is located in the abscissa.

Figure 5B:
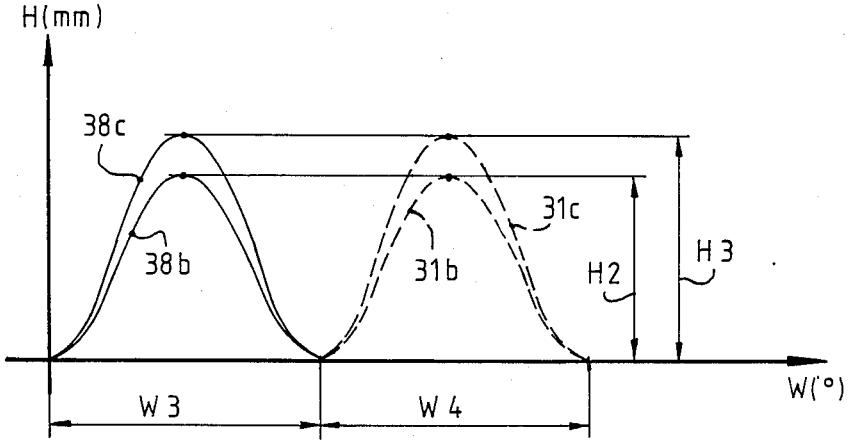

In FIG. 5*b* above the angle of rotation W of the arm shaft 6 movements of stroke H each for different maximum amplitudes of stroke H2, H3 of the presser feet 31, 38 are illusrated, which may be achieved by an adjustment of the slide block 71 located on the lever 73. The path of the holding presser foot 38 for the stroke H2 is drawn by a full line 38*b* and for the greater stroke H3 by a full line 38*c*. The path of the feeding presser foot 31 for the stroke H2 is drawn by a dash line 31*b*, and for the stroke H3 by a dash line 31*c*. This results in the fact that the stroke ratios and also the angles of rotation W3 and W4 do not alter.

Furthermore, it is obvious from the diagrams according to FIGS. 5*a* and 5*b* that the presser feet 31, 38 impact on the workpiece 88 with a velocity of nearly "zero".

I claim:

1. An upper feeding device of a sewing machine comprising a feeding presser foot, a holding presser foot alternatingly cooperating with said feeding presser foot to which is imparted by means of an oscillating means and an angle lever coupled thereto via a jogging mechanism an up and down movement extending perpendicular to a throat plate of the sewing machine, said jogging mechanism being provided with a movable slider and said movable slider being coupled to said angle lever via a slide guide which is positioned parallel to the direction of movement of the presser foot.

2. A device according to claim 1 wherein the movable slider is translatorily movable.

3. A device according to claim 1, wherein said oscillating means coacting with said jogging mechanism is a cam means.

4. A device according to claim 1, wherein the movable slider is drivable perpendicular to the direction of movement of the feeding presser foot and the holding presser foot.

5. A device according to claim 1 wherein the oscillating means is coupled with the movable slider via an oscillating shaft having an oscillating lever which is coupled to the movable slider via a slide block-guide.

6. A device according to claim 5 wherein a slide block of the slide block guide is supported on the oscillating lever, the distance of the slide-block to the oscillating shaft being adjustable.

7. A device according to claim 5 wherein the slide block is adjustably mounted in an oblong hole on the oscillating lever.

8. A device according to claim 1 wherein the slide guide is in the form of a slide block-guide.

9. A device according to claim 1 wherein the angle lever is subjected to pressure by means of a pressure device, the force imparted to the angle lever acting perpendicular to the throat plate.

10. An upper feeding device of a sewing machine comprising a feeding presser foot and a holding presser foot alternatingly cooperating with said feeding presser foot to which is imparted by means of an oscillating means and an angle lever coupled thereto via a jogging mechanism, an up and down movement extending perpendicular to a throat plate of the sewing machine, said jogging mechanism being provided with a movable slider and the oscillating means being coupled with the movable slider via an oscillating shaft having an oscillating lever which is coupled to the movable slider via a slide block-guide wherein a slide block of the slide block-guide is supported on the oscillating lever, the distance of the slide block to the oscillating shaft being adjustable.

11. A device according to claim 10, wherein the movable slider is translatorily movable.

12. A device according to claim 10, wherein said oscillating means coacting with said jogging mechanism is a cam means.

13. A device according to claim 10, wherein the movable slider is drivable perpendicular to the direction of movement of the feeding presser foot and the holding presser foot.

* * * * *